US007823415B2

(12) United States Patent
Gruosi-Scheufele

(10) Patent No.: US 7,823,415 B2
(45) Date of Patent: Nov. 2, 2010

(54) PIECE OF JEWELRY WITH MOBILE ELEMENTS

(75) Inventor: Caroline Gruosi-Scheufele, Prangins (CH)

(73) Assignee: Chopard International SA, Prangins (CH)

( * ) Notice: Subject to any disclaimer, the term of this patent is extended or adjusted under 35 U.S.C. 154(b) by 422 days.

(21) Appl. No.: 11/889,487

(22) Filed: Aug. 14, 2007

(65) Prior Publication Data

US 2008/0041102 A1 Feb. 21, 2008

(30) Foreign Application Priority Data

Aug. 16, 2006 (CH) ..... 1312/06

(51) Int. Cl.
*A44C 17/02* (2006.01)
*A44C 9/00* (2006.01)

(52) U.S. Cl. ..... 63/31; 63/15; 63/15.7

(58) Field of Classification Search ..... 63/15, 63/15.3, 15.6, 15.7, 15.8, 26, 31, 40, 1.14, 63/3, 33, DIG. 3; 446/267, 28, 236
See application file for complete search history.

(56) References Cited

U.S. PATENT DOCUMENTS

| | | | | |
|---|---|---|---|---|
| 2,258,413 | A * | 10/1941 | Koven | 63/31 |
| 2,514,844 | A * | 7/1950 | Cohen | 606/235 |
| 4,215,510 | A * | 8/1980 | Worrell | 446/28 |
| 6,324,868 | B1 * | 12/2001 | Chen et al. | 63/1.14 |
| 6,324,869 | B1 * | 12/2001 | Vanlioglu | 63/31 |
| 2002/0148253 | A1 * | 10/2002 | Fernandes | 63/31 |
| 2004/0194501 | A1 * | 10/2004 | Gruosi-Scheufele | 63/1.14 |
| 2005/0199007 | A1 * | 9/2005 | LaCroix | 63/28 |

FOREIGN PATENT DOCUMENTS

| | | |
|---|---|---|
| CH | 692 017 | 1/2002 |
| DE | 18 04 121 | 9/1969 |
| DE | 91 05 944 | 8/1991 |
| DE | 10 2004 007428 | 9/2004 |
| EP | 1 464 246 | 6/2004 |

* cited by examiner

*Primary Examiner*—Jack W Lavinder
*Assistant Examiner*—Emily M Morgan
(74) *Attorney, Agent, or Firm*—Bacon & Thomas, PLLC

(57) ABSTRACT

Piece of jewellery of generally toroidal shape having an annular enclosed space (18) closed upon itself of which the outer wall (1) and/or inner wall (2) are at least partly transparent. This enclosed space (18) holds decorative elements (13) freely moving inside of it.

9 Claims, 2 Drawing Sheets

PIECE OF JEWELRY WITH MOBILE ELEMENTS

FIELD OF THE INVENTION

Object of the present invention is a piece of jewellery such as a ring, a bracelet, a pendant, a brooch or an ear-ring, and more particularly a piece of jewellery containing one or several mobile decorative elements.

SUMMARY OF THE INVENTION

The invention aims at realising a piece of jewellery, more particularly a ring, bracelet, pendant, and ear-ring offering an original and fanciful look through the inclusion of mobile decorative elements.

DETAILED DESCRIPTION OF THE PREFERRED EMBODIMENTS

The present invention relates to a piece of jewellery such as a ring, a bracelet, a pendant, a brooch, an ear-ring or the like, and notably to a piece of jewellery in the general shape of a torus or ring. As will be seen in what follows, this piece of jewellery exhibits an annular enclosed space with at least part of the outer and/or inner peripheral wall being transparent, and with at least one mobile decorative element being held in this enclosed space.

Figure 1:
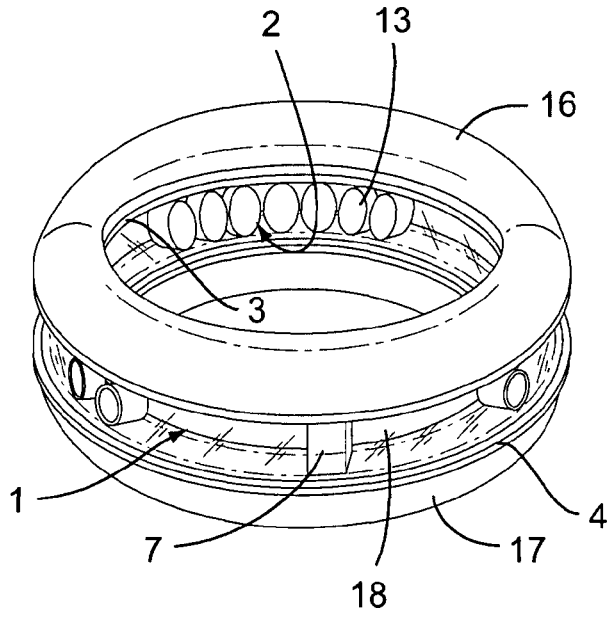
FIG. 1 is a perspective view of a ring according to the invention.
Figure 2:
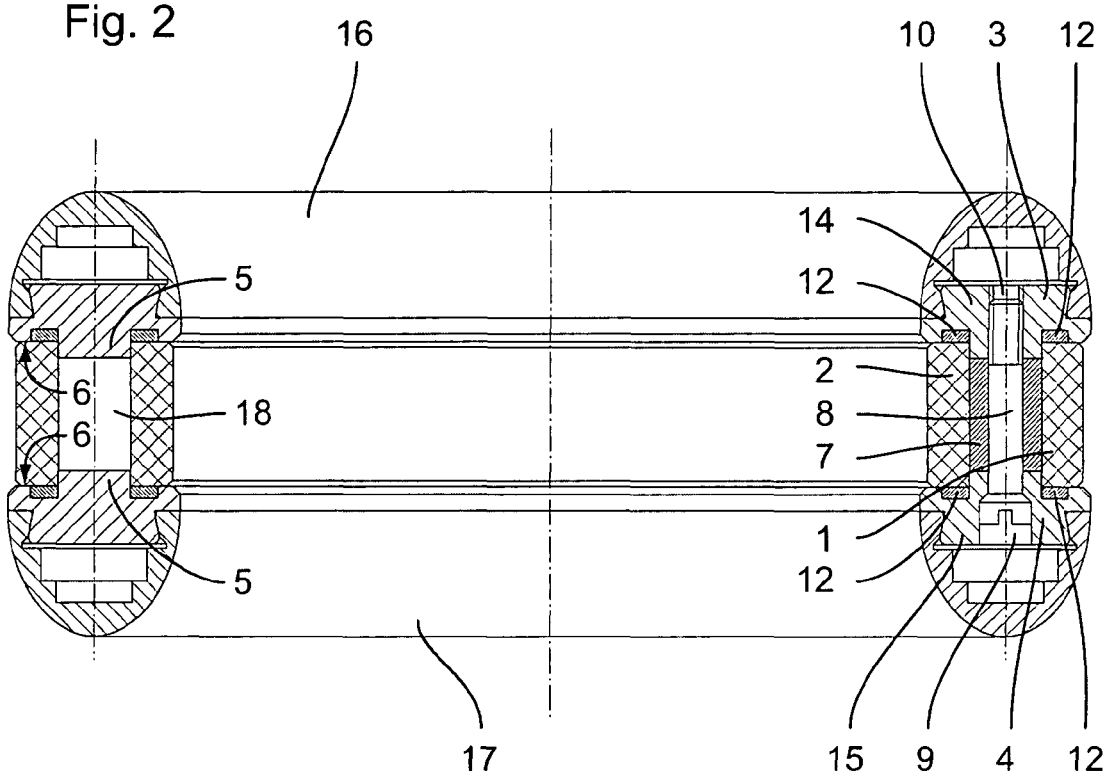
FIG. 2 is a section along a plane going through the symmetry axis of the ring illustrated in FIG. 1.

In a first embodiment of the piece of jewellery according to the invention that is illustrated in FIGS. 1 and 2, the piece of jewellery has the general shape of a torus. The central part of the piece, here a ring or bracelet, consists of an annular enclosed space with an outer peripheral wall 1, cylindrical or polygonal and made of a transparent material such as sapphire, and with an inner peripheral wall 2, cylindrical or polygonal, that may be made of a transparent material such as sapphire but is not necessarily transparent. This inner wall 2 of the enclosed space could actually be opaque or translucent, or form a mirror.

Preferably, the outer wall 1 and the inner wall 2 have the same height but differ in diameter, such that an annular void space separates them when they are placed in a mutually concentric relationship.

These walls, the outer wall 1 and the inner wall 2, are held together by an upper ring 3 and a lower ring 4 having central ribs 5 situated between the outer wall 1 and inner wall 2, and supporting faces 6 leaning against the upper and lower edges of outer wall 1 and inner wall 2. In the example illustrated in FIGS. 1 and 2, studs 7—for instance three studs 7 regularly distributed—sit between the inner wall 2 and outer wall 1, and between the upper ring 3 and lower ring 4, and are traversed by a through channel.

The lower ring 4 has holes 9, while the upper ring 3 has threaded holes 10. In the assembled piece of jewellery, holes 9 of the lower ring 4 are aligned with threads 10 of the upper ring 3, while each of the channels of studs 7 are aligned with a hole 9 and threaded hole 10. Screws 8 hold the two rings 3 and 4 toward the edges of the outer wall 1 and inner wall 2.

Gaskets 12 may be provided between the upper ring 3 and lower ring 4 and between the inner wall 2 and outer wall 1 in order to make the annular space between walls 1, 2 and rings 3, 4 watertight.

Within the enclosed space thus realised, where at least parts of the outer wall 1 or inner wall 2 are transparent, one or several decorative elements 13 are situated that may consist of metal discs, hard-stone discs, or precious or semi-precious stones cut and mounted in a setting. The dimensions of these decorative elements 13 are such that they may freely move within the enclosed space formed by walls 1, 2 and rings 3, 4 without getting wedged.

The outer faces of the upper ring 3 and lower ring 4 exhibit an engagement formation consisting—in the example illustrated—of truncated-cone ribs 14 and 15, respectively. These engagement formations 14, 15 serve to clip ring-shaped covers 16, 17 onto the upper ring 3 and lower ring 4. These covers 16, 17 typically are made of metal, for instance gold. The outside of these covers 16, 17 may have any shape, and it may be polished, or bear patterns that have been engraved or affixed in any other way.

In this embodiment, the annular enclosed space holding the decorative elements 13 is divided by studs 7 into three segments within which these decorative elements 13 are free to move under the effects of gravity and of motions imparted on the piece of jewellery.

The mobility of these decorative elements 13 in said enclosed space where at least part of the outer wall 1 and/or inner wall 2 is transparent produces a new attractive or fanciful aesthetic effect.

In the example illustrated in FIGS. 1 and 2, the piece of jewellery is a ring or bracelet. When it is a pendant, ear-ring or brooch, the piece of jewellery described while referring to FIGS. 1 and 2 is provided with a fastening device such as a ring through which a chain can be passed, or a pin so that it can be fastened to fabric, or a clip so that it can be fixed on an ear-lobe.

Figure 3:
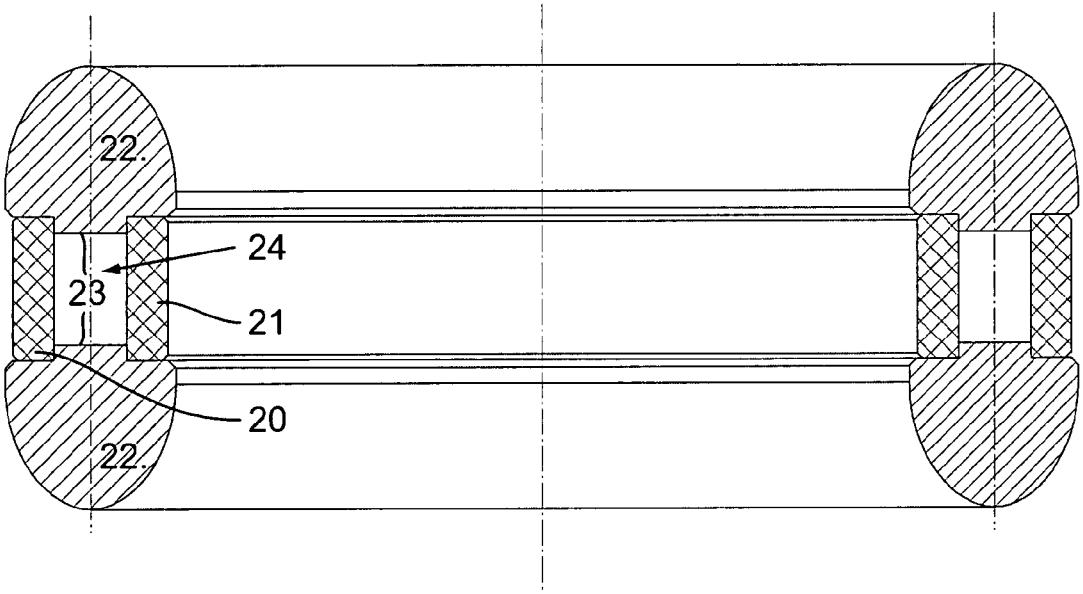
FIG. 3 is a section similar to that of FIG. 2, of a variant of the piece of jewellery according to the invention.

In the variant illustrated in FIG. 3, the piece of jewellery again has an annular enclosed space—circular or polygonal—that is formed by an outer wall 20 that is at least partly transparent, an inner wall 21 that is opaque or transparent, and two terminal parts 22 having a rib 23 between walls 20, 21. These terminal parts 22 are glued or welded to the edges of walls 20, 21 thus delimiting the enclosed space 24 that holds the decorative elements such as those described while referring to FIGS. 1 and 2. In this variant the decorative elements may move within all of the enclosed space 24, because studs are not used to fasten the terminal parts 22 on walls 20, 21.

In variants, the shape of covers 16, 17 or of the terminal parts 22 may vary, and exhibit a decoration depending on the aesthetic effect that is desired.

The inner walls 2, 21 and outer walls 1, 20 may be cylindric or polygonal without necessarily being straight in the direction of the axis of the piece of jewellery.

It is important that the piece of jewellery, of generally toroidal shape, has an enclosed space that is or is not divided into several compartments and holds at least one decorative element preferably consisting of a precious or semi-precious stone mounted in a setting, and able to freely move within the enclosed space or within the portions of the enclosed space that are mutually separated. As was seen from the examples described, this enclosed space is preferably closed upon itself, and is generally ring-shaped.

The invention claimed is:

1. Ring-shaped article of jewelry, comprising an outer peripheral wall, an inner peripheral wall, an upper ring and a lower ring forming between them an annular enclosed space closed upon itself, with at least part of the outer peripheral wall and/or inner peripheral wall defining at least in part the enclosed space being transparent; the enclosed space containing at least one decorative element free to move therein, wherein the decorative element or elements comprise one or more precious or semi-precious stones mounted in a setting.

2. Ring-shaped article of jewelry according to claim 1, wherein the outer peripheral wall is totally transparent.

3. Ring-shaped article of jewelry according to claim 1, wherein the inner peripheral wall is transparent.

4. Ring-shaped article of jewelry according to claim 1, wherein the outer peripheral wall and inner peripheral wall of the enclosed space are concentric, cylindrical, and secured with the aid of screws between the upper ring and the lower ring.

5. Ring-shaped article of jewelry according to claim 4, wherein the upper and lower rings have inner ribs extending between the inner peripheral wall and outer peripheral wall.

6. Ring-shaped article of jewelry according to claim 4, wherein the upper and lower rings have engaging formations on their exterior arranged to engage and to be fastened to a cover forming axial ends of the article of jewelry.

7. Ring-shaped article of jewelry according to claim 1, including terminal parts glued or welded to the edges of the inner and outer peripheral walls.

8. Ring-shaped article of jewelry according to claim 4, wherein the enclosed space is divided by studs into several segments or compartments.

9. Ring-shaped article of jewelry according to claim 4, wherein the enclosed space is divided by studs into several segments or compartments, and the screws pass through the studs.

* * * * *